US005115932A

United States Patent [19]

Schneider

[11] Patent Number: 5,115,932

[45] Date of Patent: May 26, 1992

[54] SEALING OF CONTAINERS WITH A SCREW SEALING CAP AND A TEAR-OFF SECURITY STRIP

[75] Inventor: Bernard Schneider, Ste Menehould, France

[73] Assignee: Cebal, Clichy, France

[21] Appl. No.: 627,048

[22] Filed: Dec. 13, 1990

[30] Foreign Application Priority Data

Dec. 15, 1989 [FR] France ..... 89 17203

[51] Int. Cl.[5] ..... B65D 41/34

[52] U.S. Cl. ..... 215/252; 215/258

[58] Field of Search ..... 215/252, 258

[56] References Cited

U.S. PATENT DOCUMENTS

| | | | |
|---|---|---|---|
| 2,423,582 | 7/1947 | Coleman | 215/252 |
| 2,970,711 | 2/1961 | Goldstein | 215/252 |
| 3,199,702 | 8/1965 | Fischbach | 215/252 |
| 3,249,247 | 5/1966 | Babiol | 215/252 |
| 3,310,191 | 3/1967 | Kern et al. | 215/252 |
| 3,874,540 | 4/1975 | Hidding | 215/252 |
| 3,902,621 | 9/1975 | Hidding | 215/252 |
| 3,955,696 | 5/1976 | Finke | 215/214 |
| 3,980,195 | 9/1976 | Fillmore | 215/256 |
| 4,062,466 | 12/1977 | Conti | 215/252 |
| 4,326,639 | 4/1982 | Stahl et al. | 215/252 |
| 4,337,870 | 7/1982 | Keeler | 215/252 |
| 4,415,094 | 11/1983 | Bavnsfelt | 215/252 |
| 4,448,318 | 5/1984 | Lowe | 215/252 |
| 4,534,480 | 8/1985 | Santostasi et al. | 215/252 |
| 4,548,329 | 10/1985 | Curry | 215/216 |
| 4,609,115 | 9/1986 | Moore et al. | 215/252 |
| 4,638,917 | 1/1987 | Persch | 215/252 |
| 4,771,904 | 9/1988 | Perne et al. | 215/252 |
| 4,830,207 | 5/1989 | Battegazzore | 215/252 |
| 4,848,613 | 7/1989 | Nofer | 215/252 |
| 5,056,675 | 10/1991 | Julian | 215/252 |

FOREIGN PATENT DOCUMENTS

| | | | |
|---|---|---|---|
| 0008190 | 2/1980 | European Pat. Off. | 215/252 |
| 2229620 | 12/1974 | France | 215/252 |
| 570311 | 11/1974 | Switzerland | 215/252 |

*Primary Examiner*—Stephen Marcus
*Assistant Examiner*—Vanessa Caretto
*Attorney, Agent, or Firm*—Dennison, Meserole, Pollack & Scheiner

[57] ABSTRACT

A container and its threaded sealing cap with a tear-off security strip, a constricted portion of the container being threaded and provided with flexible teeth having an increasing spring action ratcheting with notches of the security strip, and having a mechanical strength making it possible to guarantee that the container is tamper-proof, while insuring ease of opening after tearing off the security strip.

20 Claims, 11 Drawing Sheets

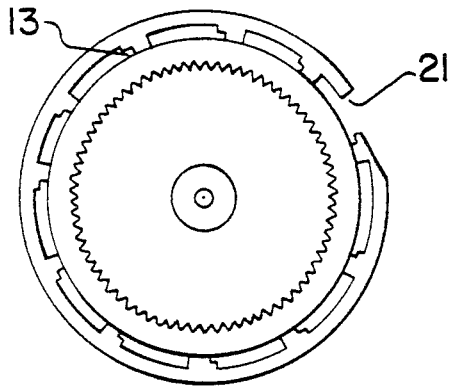
FIG. 3.1
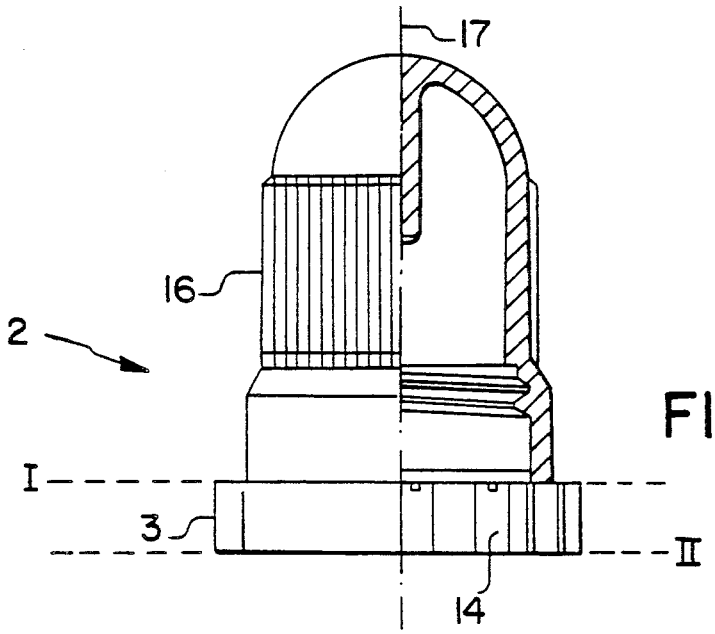
FIG. 3.2
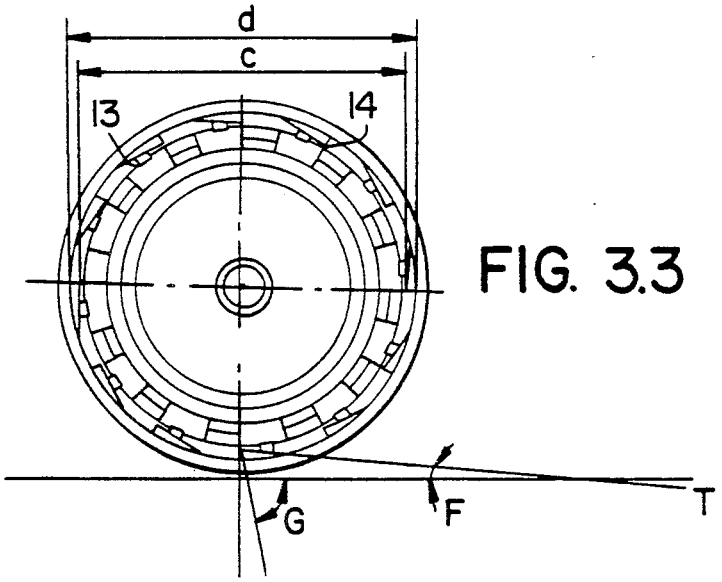
FIG. 3.3

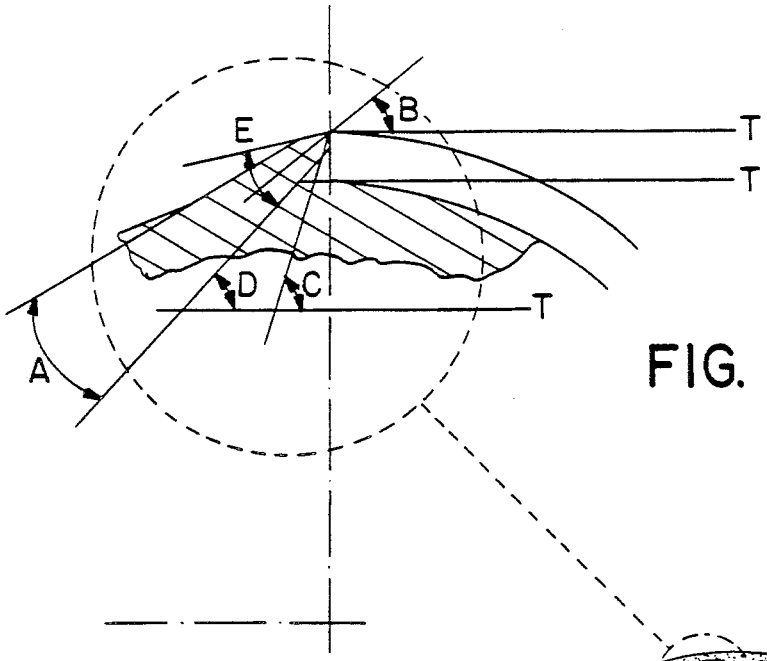
FIG. 5.2
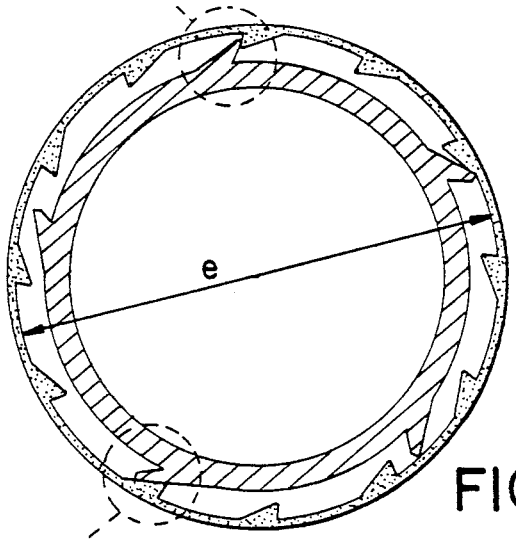
FIG. 5.1
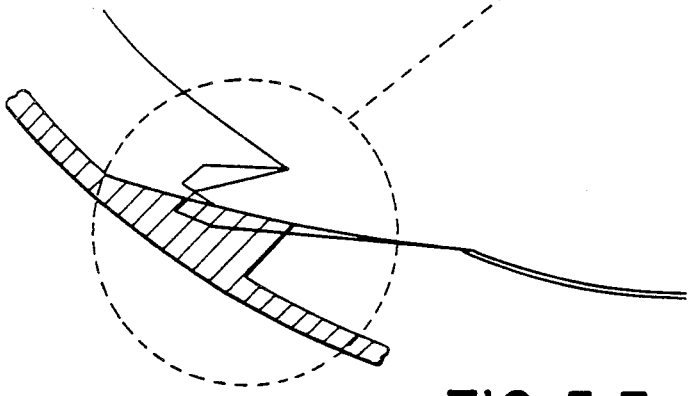
FIG. 5.3

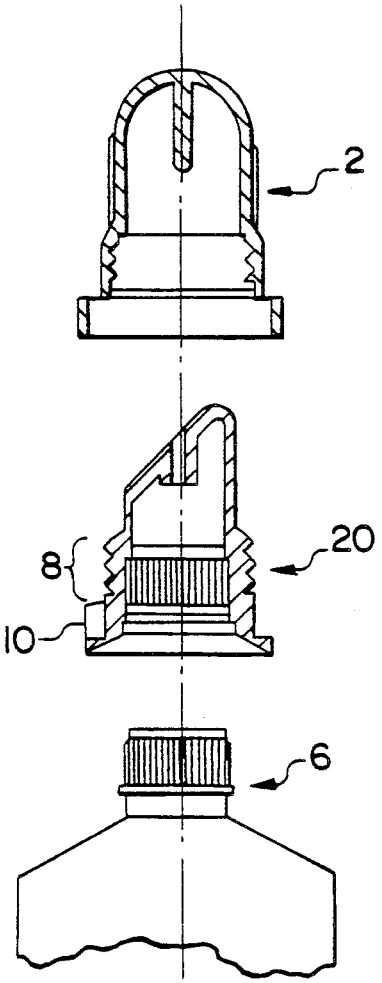
FIG. 7.1
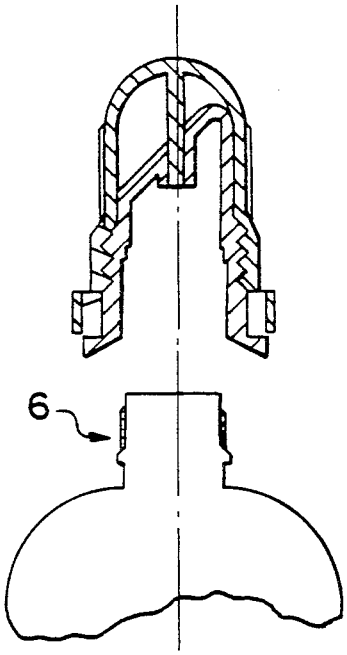
FIG. 7.2

SEALING OF CONTAINERS WITH A SCREW SEALING CAP AND A TEAR-OFF SECURITY STRIP

BACKGROUND OF THE INVENTION

1. Field of the Invention

The invention relates to container and its screw sealing cap and tearoff security strip and more particularly relates to an improvement to the sealing, plugging or stopping of containers having a constricted threaded zone making it possible to screw down a cap provided with its security strip.

2. Description of Related Art

Numerous tamper-proof containers already exist which have a threaded ring and are scaled by the screwing down of a cap.

As shown in FIG. 1A, one known way of ensuring inviolability consists of using on the one hand an internally threaded scaling cap (2A) which is provided with a security strip (3A) joined to the cap by bridges (13A) and which is provided on its inner face with ratchet notches (14A) and on the other hand a container (1A) provided in its constricted part or neck (6A) a portion (9A) with ratchet teeth (10A) in addition to a threaded portion (8A). On sealing the container, before or after the conditioning phase as a function of the nature of the container, tube or bottle, the cap is screwed onto the container neck and the ratchet notches and teeth ratch in such a way as to permit screwing down and so as to prevent the unscrewing of the cap, except after the security strip has been torn off.

The applicant has manufactured containers and their sealing cap with a security strip in accordance with the prior art, more particularly plastic tubes such as those defined in Example 1 and has encountered difficulties during the sealing thereof.

The problem is that there is a breaking of the bridges (13A) connecting the cap body (16A) and the security strip (3A) during the screwing down of the cap before filling the tube. Thus, the Applicant has observed a high breaking rate which can reach 20%, which makes the container industrially unusable. The Applicant has also observed the presence of tubes which were no longer tamper-proof, because it was possible to unscrew the cap without breaking the bridges, which is obviously unacceptable.

In order to solve this problem, the Applicant has attempted to reduce the ratcheting, i.e. the interpenetration of the teeth (10A) and the notches (14A) but, although there was then a reduction in the breaking rate, there was also an increase in the number of tubes which were no longer tamper-proof. Therefore this solution was abandoned.

In industrial production, the characteristic parameters and in particular the geometrical dimensions have a certain tolerance including, inter alia, the machining precision of the production tools, their wear prior to replacement, etc., so that there can be a certain variation in the quality of the goods produced, which is normal but not desirable. In the case of the production of the tubes of Example 1, the final quality is too sensitive to the normal variations of the production parameters, because in the same production batch there are both satisfactory tubes, tubes with broken bridges and tubes which are not tamper-proof, so that this type of tube is not industrially acceptable.

Consideration has also been given to reinforcing the bridge, but this leads to making the opening more difficult. Opening should involve a manual tearing away of the security strip without exerting any particular force and without using tools such as pliers. Therefore this solution was also unacceptable.

SUMMARY OF THE INVENTION

The Applicant has been able to solve these problems firstly by means of a tooth profile permitting a screwing down with limited mechanical stress, so as not to cause a breaking of the bridges and while ensuring the inviolability of the container. In addition, this is reliably ensured over the entire industrial production process.

The invention as shown in FIG. 1 relates to a container (1) and its tamper-proof sealing cap (2) having a cap body (16) and a guarantee strip (3) which can be torn off manually. The container comprises a hollow body (4) extended by a shoulder (5) and terminated by an axially symetric neck (6) having an orifice (7) and over its outer surface a threaded portion (8) permitting the screwing of said cap body and a portion (9) equipped with ratchet teeth (10) intended to prevent unscrewing, except in the case of tearing off the guarantee strip (3), the cap (2) having a threaded portion (11) on the inner surface of the cap body and an unthreaded portion (12) having a security strip (3) integral with the remainder of the cap due to bridges (13) and internally provided with ratchet notches (14) permitting the ratcheting of the teeth (10), characterized in that:

1) the teeth are made from a plastic material, and each has an external circumferential wall 30 located in a plane 31, and an internal circumferential wall 32 located in a plane 33, planes 31 and 33 forming an angle A, between 0° and 30 °, with each other, the external circumferential wall and the internal circumferential wall each being attached at one end thereof to the neck portion at the base 28 of the tooth;

2) a line 34 bisecting angle A forms an angle B, between 15° and 45°, with a tangent T intersecting the neck portion at the attachment of the internal circumferential wall;

3) the internal wall 32 terminates in an internal end wall portion 36 located in a plane 37 forming an angle C, between 45° and 90°, with tangent T, wall portion 36 offering resistance to unscrewing;

4) the plane 33 of internal wall 32 forms an angle D with the tangent T, angle C being greater than angle D;

5) the teeth, integral over their entire height with the neck portion (9) have the free upper end (18), whereas the lower end (19) is fixed so as to have an increasing spring action aiding the return of the tooth to its initial position after the passage of the notches (14) during the screwing down of the sealing cap, the characteristics permitting a screwing of the cap not leading to the breaking of the bridges (13) and ensuring the inviolability of the sealed container.

Research carried out by the Applicant for solving the set problem has shown that it was necessary to act simultaneously on the tooth fineness (characterized by the angle A), on its orientation (characterized by the angle B), on the orientation of the unscrewing resistance plane (characterized by the angle C) and the need of having a tooth with a fixed lower end.

The cross-section of the tooth according to the invention makes it possible to bend the end of the tooth under the pressure exerted by the notches during screwing down and the return of the end of the tooth to its initial position after the passage of the notches, so as to enable the cap to be screwed down with a limited force and while preventing an unscrewing of the cap, except when the guarantee strip is deliberately torn off. The external circumferential wall can terminate in an external end wall portion 38 which intersects wall portion 36 at a tip 40 of the tooth, forming an angle E, exceeding angle A by 10° to 30°. In this case, the tooth has a pentagonal cross-section. The plastic material constituting the flexible teeth (10) generally has a hardness or rigidity which is less than that of the material constituting the notches (14).

The preferred range according to the invention for angle A is between 15° and 25°, for angle B between 25° and 40° and for angle C between 55° and 75°.

The influence of the cross-section of the tooth becomes very clear on comparing FIG. 8 and FIGS. 9 and 10 illustrating the screwing force or stress, expressed by the screwing torque in Ncm, in the respective cases of a plastic tube according to the prior art (described in Example 1) and according to the invention (described in Example 2). The screwing torque is two to three times greater for the prior art tube than for the tube according to the invention and it increases considerably during screwing according to the prior art, which leads to the breading of the bridges on screwing down in a large number of cases and optionally, when the bridges do not break on screwing down, to a possible unscrewing of the cap without breaking the bridges as a result of abrasion of the teeth and notches during screwing.

The increase in the screwing torque during sealing is due to the fact that each tooth, from a mechanical standpoint, behaves like a beam fixed over its entire height, as well as its base, in such a way that during the screwing operation, the notches move closer and closer to the base of the teeth, so that the flexibility of the teeth decreases.

Although the profile of the tooth is the essential means for achieving the objective of the invention, other means also contribute thereto. It is advantageous according to the invention to bring about a ratcheting of the teeth and the notches when the cap and the container neck are aligned along the same axis in order to prevent local stresses on the guarantee strip, which could lead to a breaking of the bridges.

According to a first embodiment, alignment is helped by choosing a cap and a threaded neck container such that the start of screwing, commencing the helical movement, precedes the start of ratcheting, which can be expressed geometrically. The height of the unthreaded zone (12) of the cap essentially incorporating the guarantee strip is less than that of the threaded portion (8) of the neck, the heights being measured along the axis (17) of the tube and the cap.

According to a second embodiment, which can optionally be combined with the first, the threaded portion (8) of the neck is extended by an unthreaded cylindrical portion (15) having an external diameter slightly smaller than the internal diameter of the threaded portion (11) of the cap, so as to keep the cap and the neck in the coaxial position. This unthreaded portion (15) can have substantially the same height as the threaded portion (8).

It is very advantageous that, during screwing, there is simultaneously only a single passage of the tooth on the notch. This amounts to having a number "d" of teeth and "c" not having between them a lowest common denominator outside unity, so that at least one of the two numbers c and d is uneven. This leads to screwing with ratcheting with a limited mechanical stress, which may not exceed 5 Ncm, which reduces the risks of bridges breaking on sealing.

Surprisingly, the resistance to unscrewing due to the ratcheting of the teeth and the notches is only slightly modified and remains at a high level of approximately 50 Ncm, although only one tooth and one notch are simultaneously in engagement, which shows that a single tooth, due to its profile according to the invention, has a mechanical strength greater than that of all the connecting bridges (13) connecting the guarantee strip (3) and the cap body (16). Naturally, there is no further significant unscrewing resistance after the tearing off of the security strip, apart from the normal unscrewing torque (generally approximately 50% of the initial tightening torque).

In addition, it is desirable that between two successive passages of the tooth on the notch, the rotation angle of the cap, with the neck fixed, is not high and is between 5° and 20°. In the case of numbers c and d not having a lowest common factor outside unity, this is obtained for numbers c and d such that their products $c \times d$ is respectively between 360/5 and 360/20. Preference is given to a rotation angle between two passages between 8° and 15°.

According to the invention, the sealing cap used is made from a plastic material, typically polypropylene, with a security strip (3) in the form of a circular strip, which is broken between two bridges so as to offer an easily manually grippable tearing start (21) and having no bulge with respect to the circumscribed diameter of said strip.

Many tamper-proof packs and containers have tongues or other additions intended to facilitate gripping and which project beyond the actual guarantee strip. Such material bulges are not necessary in the invention, which is a considerable advantage, both from the sealing productivity standpoint, because the cap has an axial symmetry, there is no need for a shape search and there is no possibility of the security strip jamming, while on the other hand from the esthetic standpoint there is a considerable improvement to the clean line appearance, which is particularly appreciated in the cosmetics field. In general, the plastic material constituting the cap and its security ring is more rigid that that constituting the integral teeth of the container neck.

Typically, in the case of an all plastic container, such as a tube, the cap can be made from polypropylene and the teeth and the remainder of the tube from polyethylene, the hardness or rigidity differences of the two materials aiding the actual sealing.

The invention is also applicable to composite containers, constituted on the one hand by a hollow body made from metal, glass, rigid plastics, multilayer metalloplastics, such as a metalloplastic tube, or a rigid or flexible multilayer plastic material, such as a pouch, but having on the other hand a plastic material neck and/or shoulder generally made from a mouldable plastic material, such as polyethylene, which makes it possible to produce the flexible teeth according to the invention. More specifically, the teeth are obtained by injection whereas extrusion-blowing or injection-blowing processes do not make it possible to obtain the necessary tooth fineness according to the invention.

The invention is also applicable to containers having a neck which, due to the nature of the material or the production process, does not permit the formation of flexible teeth. In this case, in order to be able to achieve the aim of the invention, an end fitting (20) having the teeth (10) according to the invention and a thread (8) is joined by any known means to the container neck or shoulder, including overmoulding, welding, bonding and more generally any means ensuring a tight fixing of the end fitting to the container neck. Apart from a thread and teeth, the end fitting (20) can have a portion (15) facilitating the orientation of the cap during sealing or other means intended to facilitate the use of the contained product.

According to FIG. 7A, it is possible to position the end fitting (20) on the container neck (6). However, it is advantageous from the industrial manufacturing standpoint to produce the end fitting (20) by injection, fit it seperately to the cap in the manner indicated in FIG. 7B and then to join these two parts on the container neck.

The materials used for these containers can be plastic, metal, glass ceramics, as well as multilayer metalloplastics. These containers can be aluminum tubes, glass bottles or flasks, as well as flexible or rigid, multilayer metalloplastic material packs.

Moreover, according to the invention it is possible to reverse the position of the teeth and the notches with a "hard" material container carrying teeth on its neck and a "softer" plastic material cap carrying flexible teeth on its security strip.

The invention imposes no limitation regarding the size of the container and the caps. Generally, the external diameter of the threaded portion of the container neck is between 10 and 80 mm.

The advantages of the invention are firstly of an economic nature with the elimination of production losses occurring during sealing in the prior art and at the same time facilitating sealing, so that the production rates and therefore the productivity can be increased.

Another advantage of the invention relates to the inviolability and quality of the goods produced, so that with such a low tooth-on-notch passage clearing torque during screwing and such a high unscrewing torque with the breaking of the bridges, the ratio between the two can rise to 10, and the invention ensures that the containers are tamper-proof.

BRIEF DESCRIPTION OF THE DRAWINGS

FIGS. 3A–3C show a sealing cap with bottom, cross-sectional and end views, respectively;

FIGS. 5A–5C illustrate a cap with five teeth, according to Example 2 of the invention;

FIGS. 7A and 7B illustrate the joining of plastic end fittings on an aluminum tube and a glass bottle, respectively;

DESCRIPTION OF THE PREFERRED EMBODIMENTS

FIG. 3A is a plan view showing plane 1 perpendicular to the axis (17), with the circular security strip interrupted between two bridges and having a tearing start (21), one of the ends being bevel cut to facilitate the gripping of the other end during the tearing of the security strip, FIG. 3B is a sectional view in the plane of the axis (17). FIG. 3C is a view from below making it possible to see the plane 11 perpendicular to the axis (17), as well as the orientation of the notches, the angle F being 10° and the angle G 75°.

Figure 1:
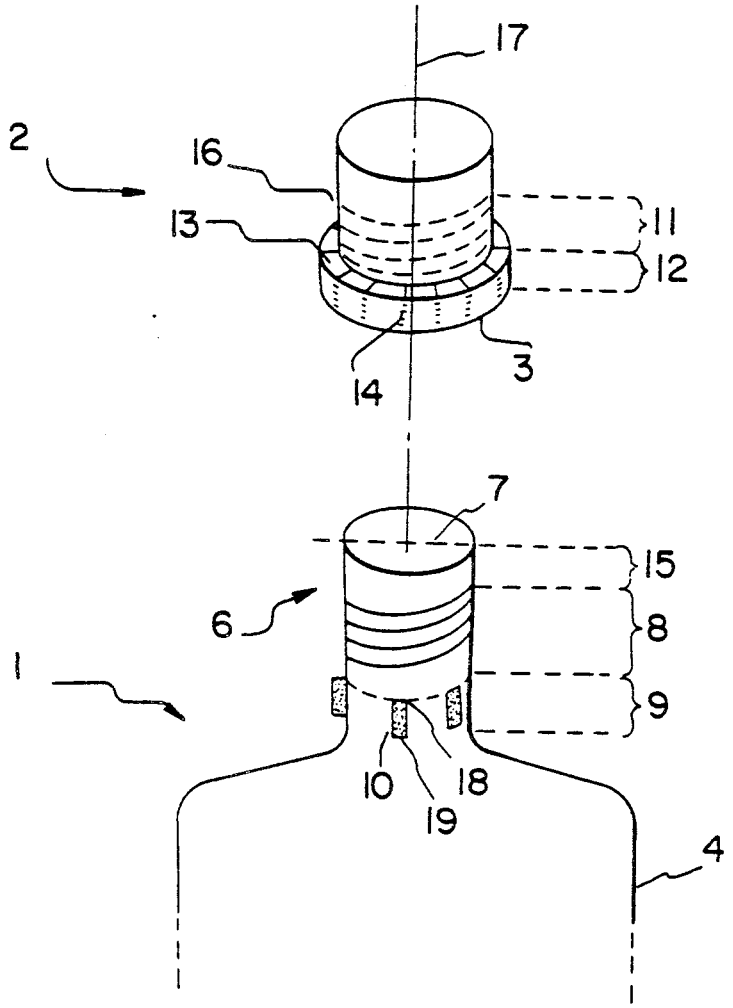
FIG. 1 is a plan view of a container and a tamper-proof sealing cap, according to the invention.
Figure 1A:
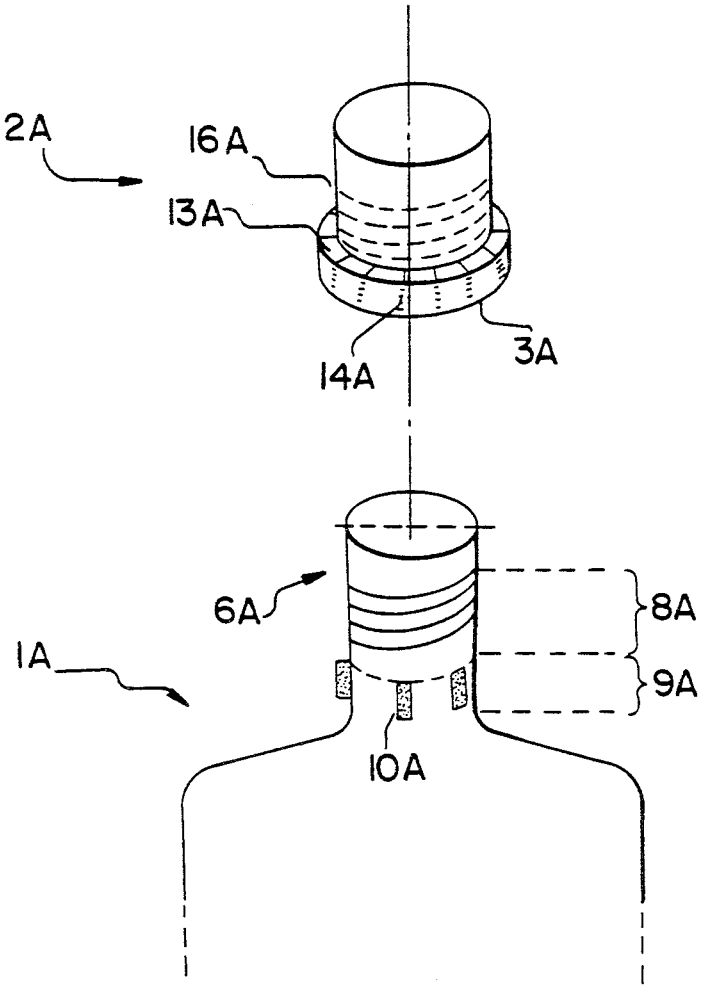
FIG. 1A PRIOR ART
FIG. 1A is a plan view of a container and a tamper-proof sealing cap, as is used according to the prior art.
Figure 2:
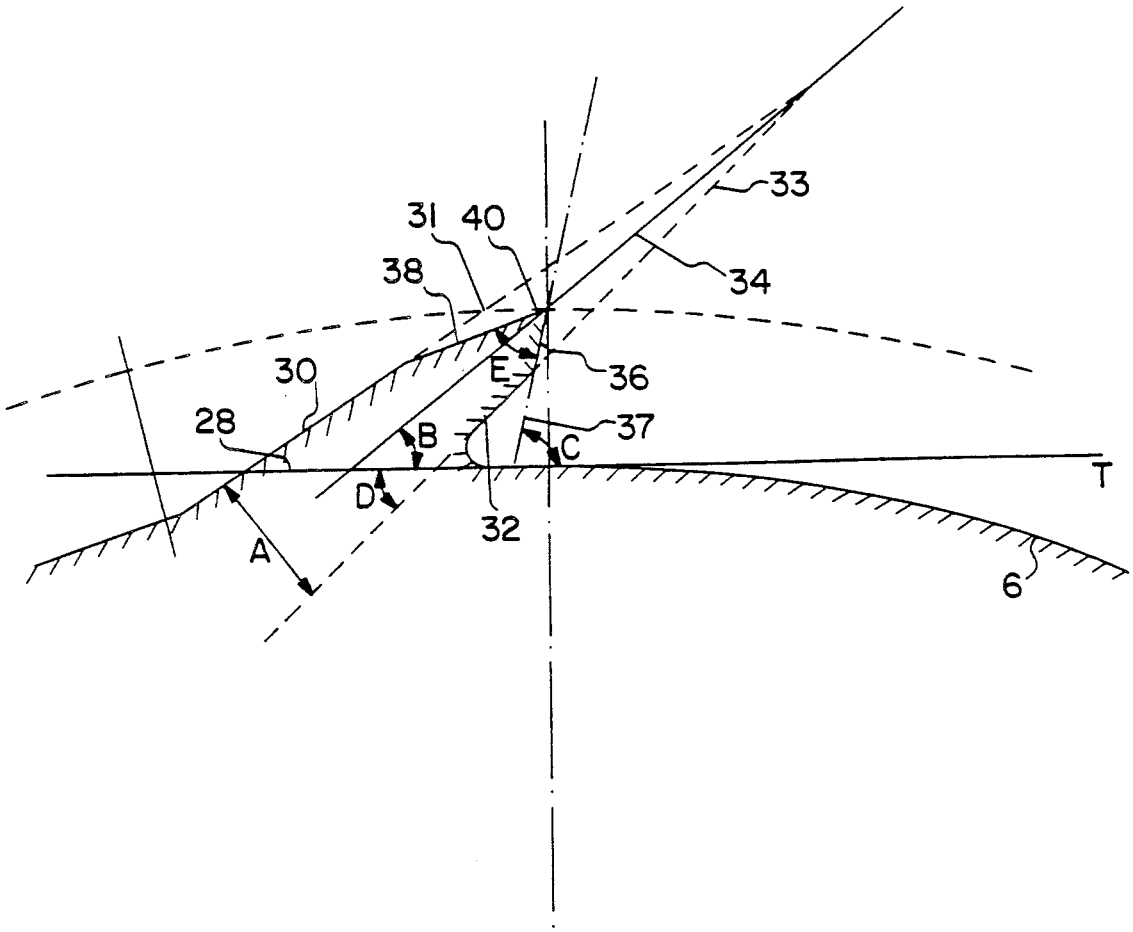
FIG. 2 shows the profile of a tooth according to the invention in the plane perpendicular to the axis (17)
Figure 4:
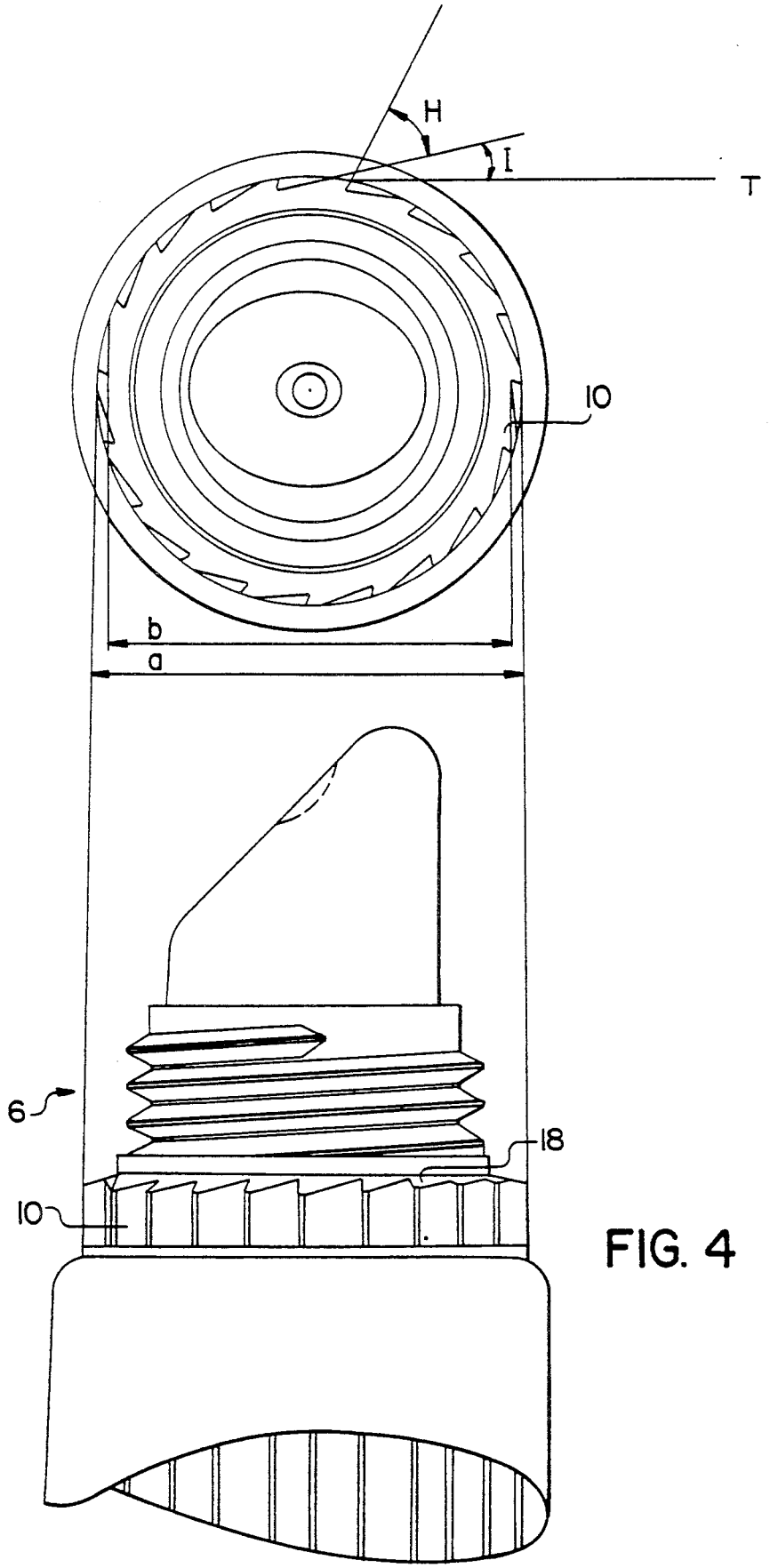
FIG. 4 shows a prior art tube and cap.

FIG. 4 shows a prior art tube with teeth having a substantially triangular profile and with a topped end having an angle H of 75° and an angle I of 25°.

FIGS. 5A–5C illustrate the invention and show a plane of a tube with five teeth according to Example 2, in a section pependicular to the axis (17) at the teeth. FIG. 5A shows the relative position of the teeth and the notches with a tube having five teeth and a cap having twelve screwed notches. FIG. 5B shows the profile of the tooth with the values of all the angles; A=18°, B=57°, C=73°, D=48°, E=60°.

FIG. 5C illustrates the bending of a tooth in the case of tooth-notch passage.

Figure 6:
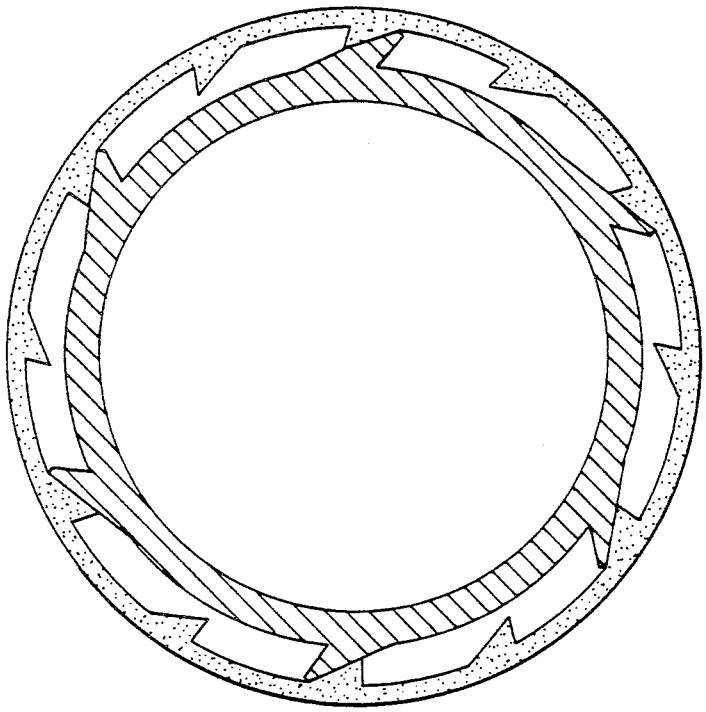
FIG. 6 illustrates a cap having six teeth, according to Example 3 of the invention.

FIG. 6 illustrates the invention and shows a sectional plane in the same way as FIG. 5A of a tube having six teeth obtained according to Example 3 with the cap having twelve screwed notches. In this case, there are simultaneously six tooth-notch passages.

FIG. 7A and B illustrate the fixing of plastic material end fittings provided with teeth and a thread to an aluminum tube (FIG. 7A) and to a glass bottle (FIG. 7B), although not shown in FIG. 7B, the glass bottle is provided with means for preventing the rotation of the end fitting, once the latter has been joined to the bottle neck.

Figure 8:
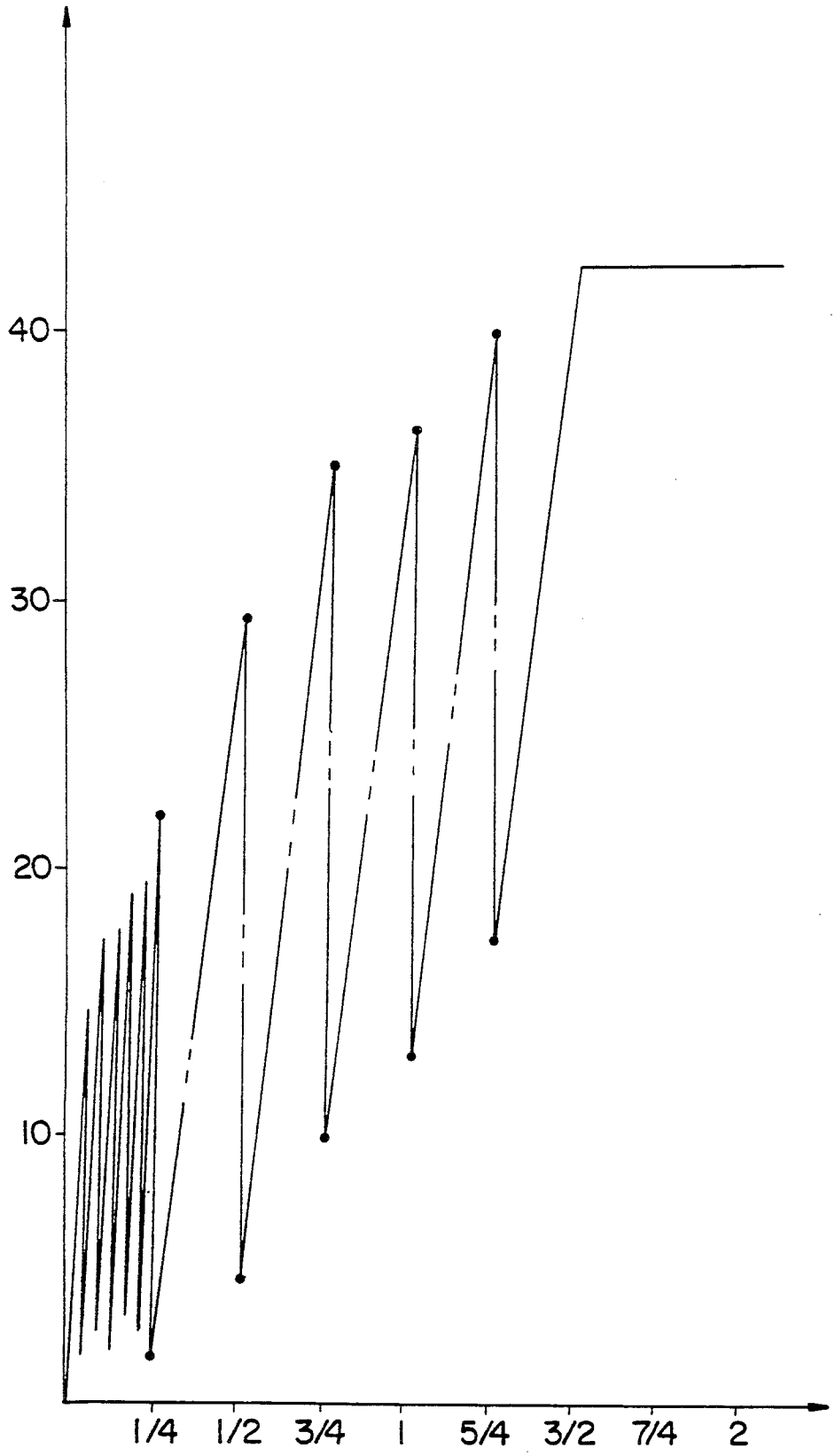
FIGS. 8–10 are plots of screwing torque versus screwing angle, expressed as the number of rotations.
Figure 9:
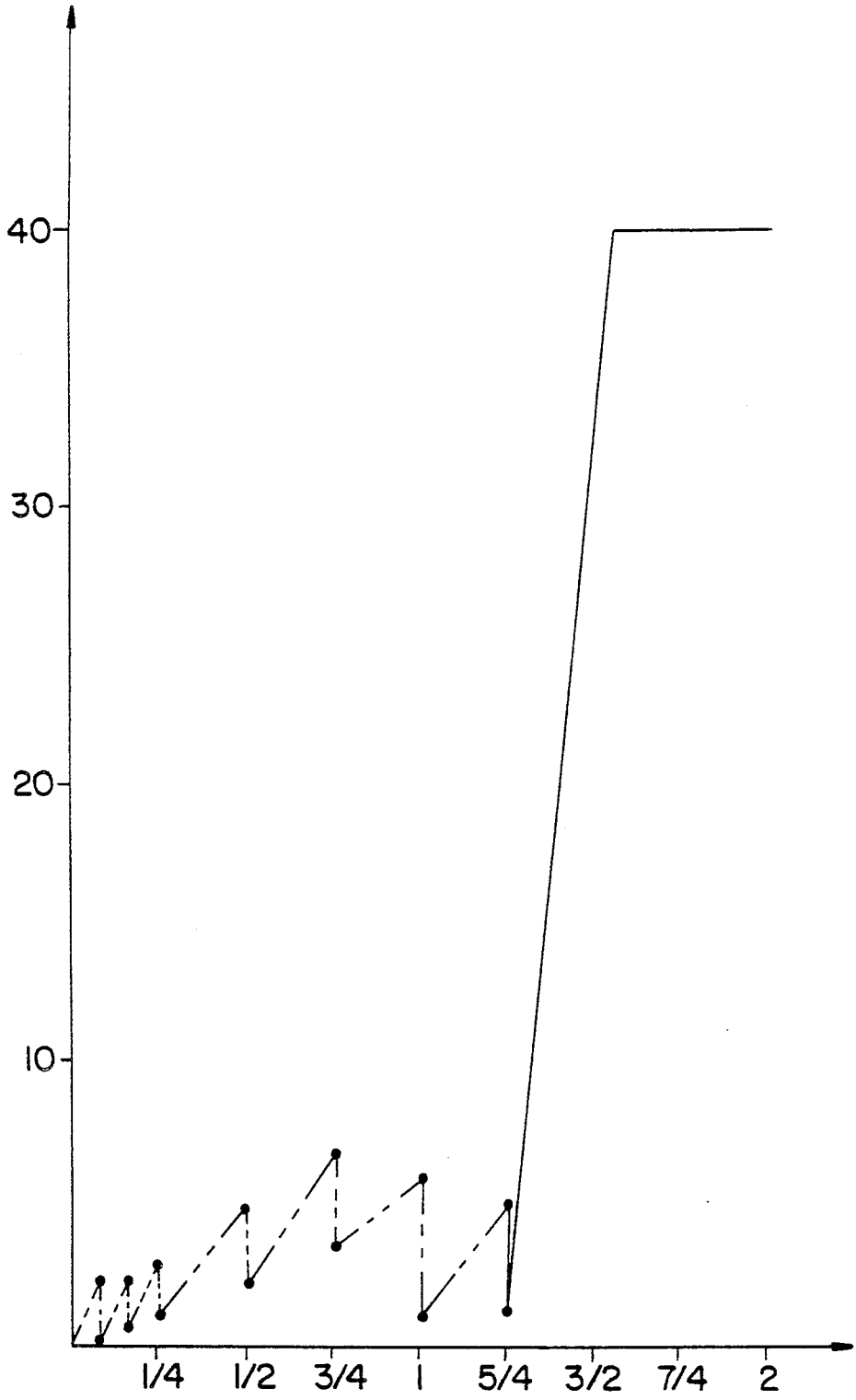
Figure 10:
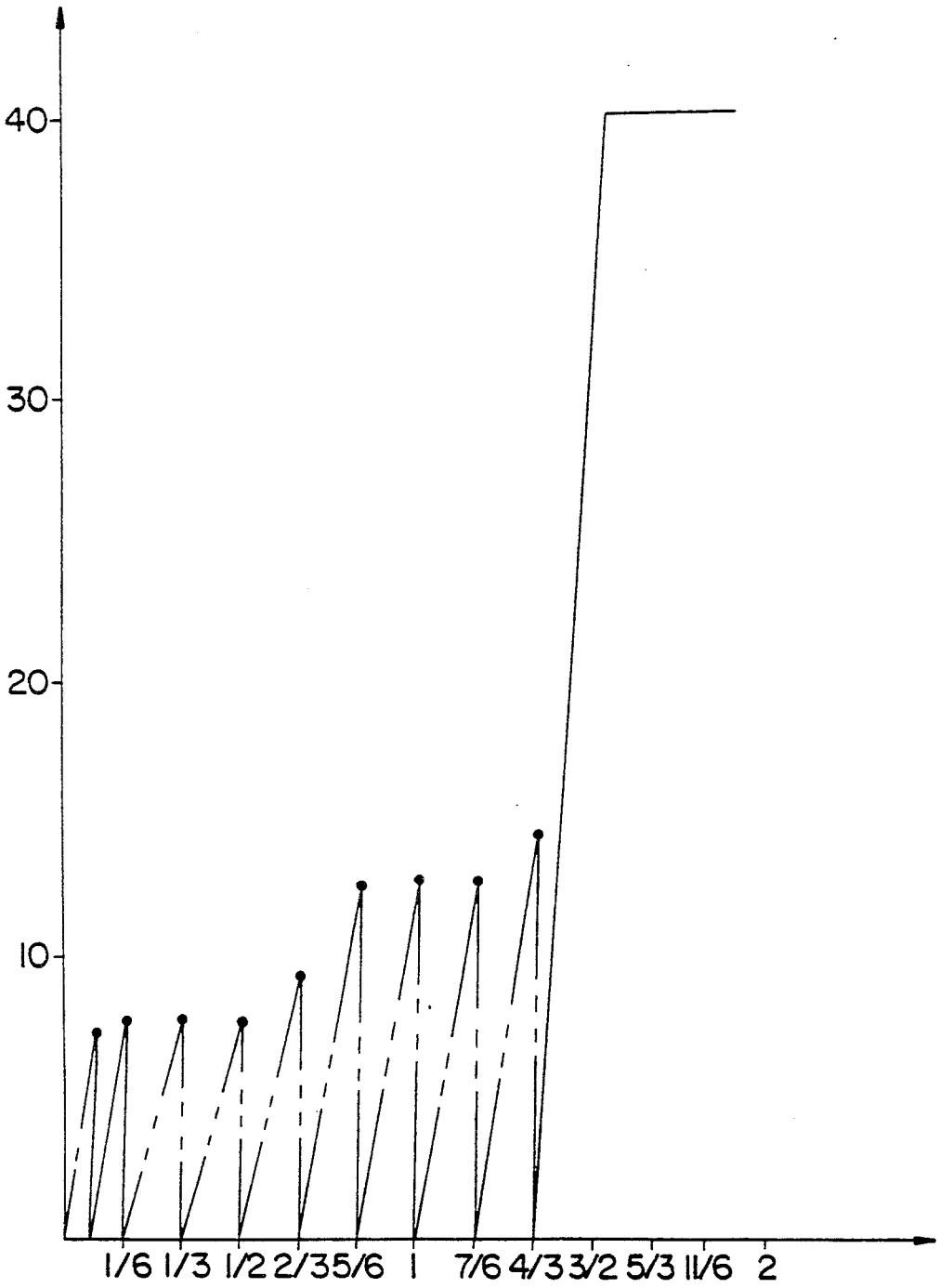

FIGS. 8,9 and 10 illustrate the intensity of the screwing torque, expressed in N.cm on the ordinate as a function of the screwing angle expressed by the number of rotations. For the clarity of the drawings, all the tooth-notch passages are not shown (broken lines). FIG. 8 corresponds to the screwing of a tube with 24 teeth according to Example 1 (prior art) and a cap with 12 notches with 12 simultaneous tooth-notch passages every 15°. FIG. 9 corresponds to the screwing of a tube with five teeth according to Example 2 (invention) and a cap with 12 notches with a single tooth-notch passage every 6°. FIG. 10 corresponds to the screwing of a tube with six teeth according to Example 3 (invention) and a cap with 12 notches with six simultaneous tooth-notch passages every 30°.

EXAMPLES

Example 1

A HD polyethylene tube was produced, whose neck (6) and more particularly teeth (10) are shown in FIG. 4. The external diameter of the tube at the teeth is 17 mm at the end of the teeth (a) and 15.7 mm at the bottom of the teeth (b).

This tube has 24 teeth with a "topped" triangular profile and with an apex angle A of 50° and whose two adjacent sides form with respect to the tangent T angles of 25° and 75°.

A polypropylene sealing cap adapted to this tube was produced and is shown in FIGS. 3A–3C. It has 12 notches (14) on the internal periphery of its security strip (3), each notch having a triangular profile with an apex angle of 65° and whereof the two adjacent sides form angles of 10° and 75° with respect to the tangent T. The internal diameter at the notches is 16.5 mm at the end of the notches and 17.7 at the bottom of the notches.

Thus, the clearance between the cap and the tube is 0.7 mm and the theoretical ratcheting prior to sealing is 0.25 mm, i.e. (17−16.5)/2.

In practice, after sealing, the external diameter of the tube at the teeth is not 17 mm but 16.6 mm. The external diameter has been reduced by 0.4 mm due to the wear to the teeth during each tooth-notch passage. The ratcheting becomes equal to 0.05 mm, which is doubtless inadequate because cases were found where it was possible to unscrew the cap without breaking the bridges.

The curve giving the screwing force is shown in FIG. 8. In very numerous cases, the bridges are broken during screwing and this is doubtless due to the excessive screwing force.

Example 2

A HD polyethylene tube similar to that in Example 1 was produced, except that it has 5 teeth and these teeth have a profile as shown in FIG. 5B with the following values for the different angles: A=18°, B=57°, C=73°, D=48° and E=60°. The external diameter of the tube at the teeth is 17.5 mm at the end of the teeth and 15.7 mm at the bottom of the teeth, as in Example 1. The cap is the same as that described in Example 1.

FIGS. 5A and C show the ratcheting of the teeth and notches in a plane perpendicular to the axis (17). The clearance between the cap and the tube is 0.2 mm and the ratcheting is 0.5 mm. After screwing down the cap, no wear to the teeth was noted, so that the external diameter of the tube at the teeth remains unchanged.

The curve giving the screwing force of Example 2 shown in FIG. 9. During sealing tests on a large number of tubes, no bridge breaking was observed and no tube could be unscrewed without breaking the bridge. In the case of forced unscrewing without tearing the security strip off beforehand there is a sequential breakage of all the bridges with a torque of 50 Ncm.

Example 3

This example is identical to Example 2, except that there are 6 teeth instead of 5. After screwing, the external diameter of the tube at the teeth is 0.1 mm, so that ratcheting passes from 0.5 to 0.45 mm. During sealing tests on a large number of tubes, the same good results were observed as in Example 2.

The ratcheting is shown in FIG. 6 and the screwing force in FIG. 10. Forced unscrewing without tearing off the security strip leads to the simultaneous breakage of all the bridges with a torque reaching 60 Ncm.

I claim:

1. Container and tamper-proof sealing cap, said sealing cap being axially symmetrical and comprising an internally threaded cap body of defined internal diameter closed at a first end thereof and open at an opposite end thereof, said cap body being extended at the open end by an unthreaded, concentric security strip of greater diameter than said cap body and having internally disposed ratchet notches, said cap body being joined to said security strip by axially disposed, frangible bridges; and said container comprising a hollow body extended by a shoulder portion and terminating in an open-ended, axially symmetrical neck externally threaded adjacent said open end, and adapted for mating with the internally threaded cap, said neck provided, in a neck portion between said external threads and said shoulder portion, with ratchet teeth adapted for mating with said ratchet notches so as to permit screwing on of said tamper-proof sealing cap with security strip, but to prevent unscrewing of said tamper-proof sealing cap without breaking said frangible bridges, said cap being manually unscrewable from said neck with breaking of said frangible bridges, said teeth being formed from a plastic material and defined by a circumferential external wall and a circumferential internal wall, each attached at one end to said neck portion, said walls located in planes forming an angle A of between 0° and 30° with each other, and a line bisecting angle A forming an angle B of between 15° and 45° with a tangent intersecting the neck portion at the attachment of said circumferential internal wall, said internal wall terminating in an internal end wall portion adapted for pressing against a notch when said cap is screwed onto said neck, said wall portion located in a plane forming an angle C of between 45° and 90° with respect to said tangent T, said angle C being greater than an angle D of intersection of the plane of the internal wall with said tangent T, said teeth being integral over their entire height with said neck portion and having a free upper end and fixed lower end, so as to present an increasing spring action aiding the teeth to return their normal position after passing the notches during screwing on of the cap.

2. Container and sealing cap according to claim 1, wherein the angle C is between 55° and 75°.

3. Container and sealing cap according to claim 1, wherein the angle A is between 15° and 25°.

4. Container and sealing cap according to claim 1, wherein the angle B is between 25° and 40°.

5. Container and sealing cap according to claim 1, wherein said circumferential external wall terminates in an external end wall portion which intersects the internal end wall portion at an angle E which exceeds angle A by 10° to 30°.

6. Container and sealing cap according to claim 1, 2, 3 or 4 wherein the teeth (10) on the container and the notches (14) on the cap are present in numbers which do not have a lowest common factor, so that there is only one simultaneous tooth on notch passage during screwing down of the cap.

7. Container and sealing cap according to claim 1, 2, 3 or 4, wherein the cap includes an unthreaded portion including said security strip having a height less than that of the threaded portion (8) of the neck, so that there has already been a start of screwing when ratcheting of the teeth (10) and the notches (14) commences.

8. Container and sealing cap according to claim 1, 2, 3 or 4 wherein the threaded portion (8) of the container neck is extended by an unthreaded, cylindrical portion (15) adjacent the open end having an external diameter close to or slightly smaller than the internal diameter of the internally threaded cap body, so as to orient along a common axis the cap and the container neck, thus facilitating commencing of screwing.

9. Container and sealing cap according to claim 1, 2, 3 or 4, wherein the cap rotates between 5° and 30° between 2 teeth on a notch.

10. Container and sealing cap according to claim 9, wherein the cap rotates between 8° and 15°.

11. Container and sealing cap according to claim 1, 2, 3 or 4, wherein the sealing cap is made from a plastic material and said security strip (3) is circular and is interrupted between two said bridges (13).

12. Container and sealing cap according to claim 1, 2, 3 or 4, wherein the neck (6) and the shoulder (5) of the container are made from an injected plastic material forming said teeth.

13. Container and sealing cap according to claim 12, wherein the container is a plastic or metalloplastic tube.

14. Container and sealing cap according to claim 12, wherein the container is a pocket shaped, flexible pouch.

15. Container and sealing cap according to claim 1, 2, 3 or 4, wherein the neck portion (9) provided with the teeth (10) and the threaded portion (8) of the container is a plastic material end fitting (20) having at least one portion (9) provided with teeth (10) and a threaded portion (8), said end fitting (20) being joined to a neck (6) or fixed to a shoulder (5), said neck or shoulder, as well as the hollow body (4) associated therewith being constituted by a material differing from an injectable plastic material.

16. Container and sealing cap according to claim 15, wherein the container is an aluminum tube.

17. Container and sealing cap according to claim 15, wherein the container is a glass bottle or flask.

18. Container and sealing cap according to claim 15, wherein the container is a ceramic container.

19. Process for production of the container and sealing cap according to claim 15, wherein said end fitting (20) is produced first and then onto it is screwed the sealing cap (2) with its security strip (3) and finally, the end fitting provided with its sealing cap is fixed to the neck or shoulder of said hollow body.

20. Container and sealing cap according to claim 1, 2, 3 or 4 with an external diameter between 10 and 80 mm, level with the threaded portion (11) of the container neck.

* * * * *

UNITED STATES PATENT AND TRADEMARK OFFICE

CERTIFICATE OF CORRECTION

PATENT NO. : 5,115,932

DATED : May 26, 1992

INVENTOR(S) : Bernard SCHNEIDER

It is certified that error appears in the above-identified patent and that said Letters Patent is hereby corrected as shown below:

Column 3, line 26, change "breading" to --breaking--.

Signed and Sealed this

Fifth Day of October, 1993

*Attest:*

*Attesting Officer*

BRUCE LEHMAN

*Commissioner of Patents and Trademarks*